United States Patent [19]

Watson et al.

[11] 4,346,985

[45] Aug. 31, 1982

[54] AUTOMATIC DEVELOPMENT CONTROL

[75] Inventors: P. Keith Watson; Lawrence J. Fraser, both of Rochester, N.Y.

[73] Assignee: Xerox Corporation, Stamford, Conn.

[21] Appl. No.: 51,650

[22] Filed: Jun. 25, 1979

[51] Int. Cl.[3] ..... G03G 15/00

[52] U.S. Cl. ..... 355/14 D; 222/DIG. 1; 355/3 DD

[58] Field of Search ..... 355/3 R, 3 DD, 14 R, 355/14 D; 222/DIG. 1; 324/452, 455, 457, 458

[56] References Cited

U.S. PATENT DOCUMENTS

| | | | |
|---|---|---|---|
| 3,430,606 | 3/1969 | Pease et al. | 222/DIG. 1 X |
| 3,527,387 | 9/1970 | Wilson | 222/57 |
| 3,635,373 | 1/1972 | Kuhl et al. | 222/DIG. 1 X |
| 3,661,452 | 5/1972 | Hewes et al. | 355/3 R |
| 3,727,065 | 4/1973 | Maksymiak | 222/DIG. 1 X |

*Primary Examiner*—Fred L. Braun

[57] ABSTRACT

An automatic development control for use in an electrophotographic apparatus. The control includes a pair of substantially planar members forming a channel therebetween through which developer flows. One of the members is constructed such that an electrostatic charge pattern is periodically formed on the surface thereof, the charge pattern being developed by the attraction of toner thereto which toner has a charge opposite to that forming the charge pattern. The member on which the developed charge pattern is formed includes a uniform, transparent conducting substrate covered with a transparent insulating layer on top of which is deposited a set of spaced-apart, opaque and electrically conducting fingers. Thus, the one member includes alternate opaque and transparent areas. By grounding the electrically conducting fingers which are all interconnected and by driving the substrate alternately positive and negative, toner is deposited on the transparent areas during the application of one half cycle of voltage and during the following half cycle the toner is deposited on the opaque fingers and scavenged from the transparent areas. The optical density of the toner deposited is directly related to the toner concentration in the developer. The one member then forms part of the toner concentration control.

2 Claims, 5 Drawing Figures

AUTOMATIC DEVELOPMENT CONTROL

BACKGROUND OF THE INVENTION

This invention relates, in general, to controls for adding toner to developer material, and more particularly, to a method and apparatus for forming a toner image and measuring the optical density of the image which density corresponds to toner concentration in the developer to which toner is to be added.

Generally in xerography, a xerographic surface comprising a layer of photoconductive insulating material affixed to a conductive backing is used to support electrostatic images. In the usual method of carrying out the process the xerographic surface is electrostatically charged uniformly across its surface and then exposed to a light pattern of the image being reproduced to thereby discharge the charge in the areas where the light strikes the layer. The undischarged areas of the layer thus form an electrostatic charge pattern in conformity with the configuration of the original image to be reproduced. The latent electrostatic image is developed by contacting it with a finely divided electrostatically attractable powder (toner). The powder is held in image areas by the electrostatic charges on the layer. It is then transferred to a sheet of paper or other suitable surface and affixed thereto to form a permanent print. The toner forms one constituent of a suitable developer material which usually comprises carrier material and pigment particles. As will be appreciated, toner depleted from the developer has to be replaced in order to maintain a certain degree of developability. This can be done either manually or automatically.

In the case of automatic developability control, the dispensing of toner which is added to the developer has been controlled by measuring the optical density of toner periodically deposited on a pair of NESA glass plates which form a channel therebetween through which some developer flows. A potential is applied first on one of the plates and then on the other. The voltage serves to attract the oppositely charged toner from the developer material as it passes between the plates. An optical sensor is provided to monitor the optical density of the toner deposited which provides signals which are employed to control the addition of toner.

The gap between the plates has been found to be too narrow when toner and carrier particles are used which are much finer than heretofore utilized, resulting in blocking of the gap. One solution to the blocking problem is to increase the spacing between the parallel plates. To compensate for the reduced strength of the development field, the period ($0.2H_z$) of the normally applied square wave (340 volts) is doubled. With such an arrangement there is the concern that with the longer time delay, a decrease in toner concentration will not be sensed by the ADC until the next cycle and this might give rise to overcorrection and instability in toner concentration. Accordingly, it would be desirable to be able to increase the gap size without decreasing the field strength.

BRIEF SUMMARY

In accordance with the present invention, there is provided a parallel plate Automatic Development Control (ADC) wherein field strength is independent of the spacing between the plates through which developer flows. To this end, one of the plate members comprises a uniform transparent electrode covered with an insulating layer on top of which is deposited a set of interconnected, electrically conductive fingers. The fingers are rendered opaque by masking, the masking being effected such that transparent areas are delimited by the opaque fingers. In other words, the plate member comprises alternate transparent areas and opaque fingers. By grounding the fingers and driving the substrate alternatively positive and negative, toner is deposited on the transparent or window areas during the positive cycle and scavenged therefrom during the negative cycle. Conversely, during the positive cycle toner is scavenged from the opaque fingers and during the negative cycle the toner is deposited on the fingers. In the case of positively charged toner, the toner would be deposited on the opaque fingers during the positive cycle and on the transparent window areas during the negative cycle.

DETAILED DESCRIPTION OF DRAWINGS

A preferred form of the invention is shown in the accompanying drawings in which.

DETAILED DESCRIPTION OF THE PREFERRED EMBODIMENT

Figure 1:
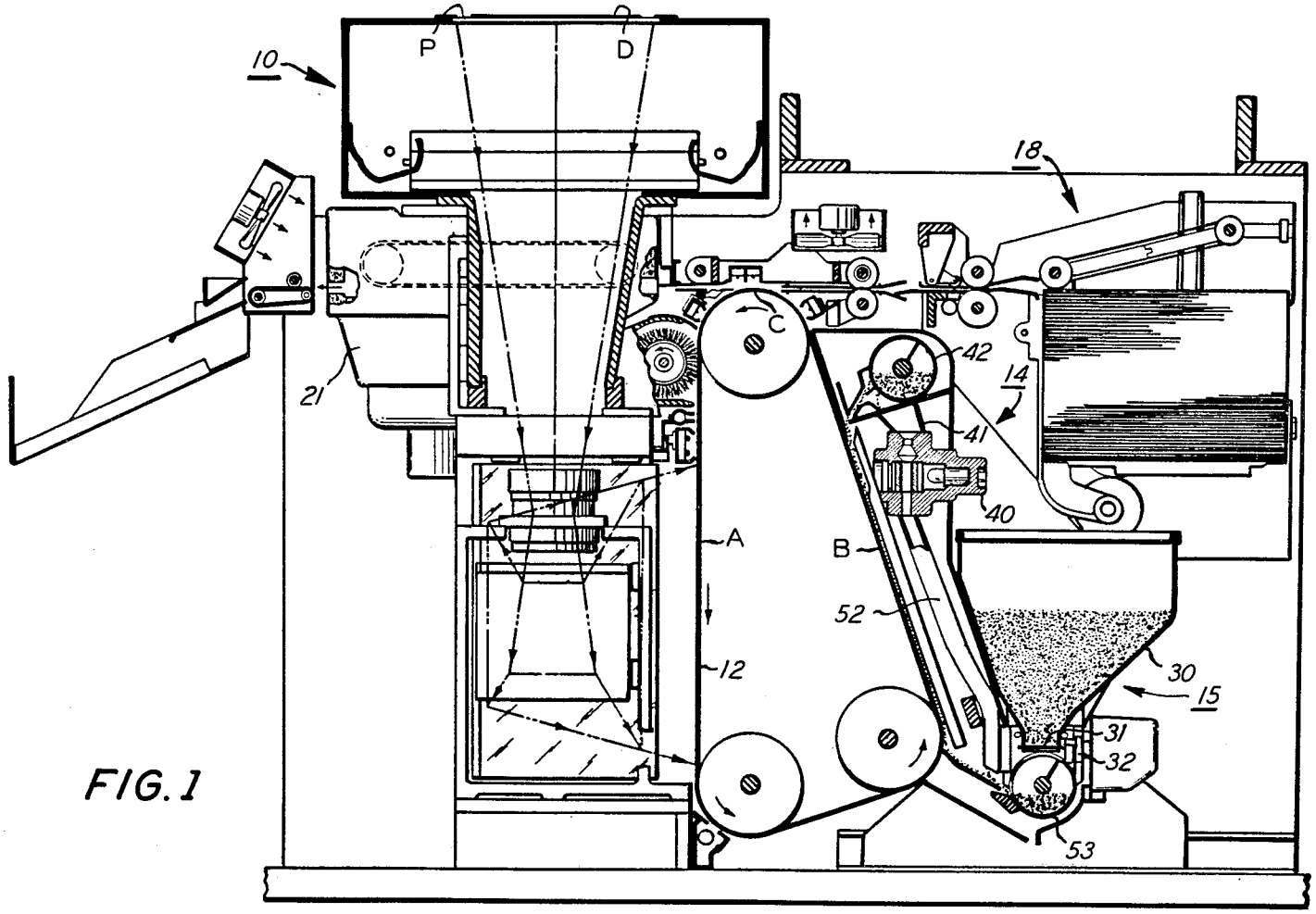
FIG. 1 is a schematic sectional view of a typical electrostatic reproduction machine embodying the principles of the invention.

For a general understanding of a typical electrostatic processing system in which the invention may be incorporated, reference is had to FIG. 1 in which various components of a typical system are schematically illustrated. As in all electrostatic systems such as a xerographic machine of the type illustrated, a light pattern is projected onto the sensitized surface of a xerographic plate to form an electrostatic latent image thereon. Thereafter, the latent image is developed with an oppositely charged developing material comprising carrier beads and smaller toner particles triboelectrically adhering thereto to form a xerographic powder image, corresponding to the latent image on the plate surface. The powder image is then electrostatically transferred to a support surface to which it may be fixed by a fusing device whereby the powder image is caused permanently to adhere to the support surface.

The electrostatically attractable developing material commonly used in dry electrostatic printing comprises a pigmented resinous powder referred to here as "toner" and a "carrier" of larger granular beads formed with glass, sand, polymer material or steel cores coated with a material removed in the triboelectric series from the toner so that a triboelectric charge is generated between the toner powder and the granular carrier. The carrier also provides mechanical control so that the toner can be readily handled and brought into contact with the exposed xerographic surface. The toner is then attracted to the electrostatic latent image from the carrier to produce a visible powder image on an insulating surface while the partially toner-depleted carrier beads are brought back into the developing system for the machine wherein it is mixed with developing material and a new supply of toner prior to reuse.

In the illustrated machine, an original document, D, to be copied is placed upon a transparent support platen P fixedly arranged in an illumination assembly generally indicated by the reference numeral 10. While upon the platen, an illumination system flashes light rays upon the original thereby producing image rays corresponding to the informational areas on the original. The image rays are projected by means of an optical system to an exposure station A for exposing the photosensitive surface of a moving xerographic plate in the form of a flexible photoconductive belt 12.

The exposure of the belt surface to the light image discharges the photoconductive layer in the areas struck by light, whereby there remains on the belt a latent electrostatic image in image configuration corresponding to the image of the original on the supporting platen. As the belt surface continues its movement, the electrostatic image passes through a working zone or developing station B in which there is positioned a developer assembly generally indicated by the reference numeral 14 and where the belt is maintained in a flat condition. The developer assembly 14 comprises horizontally and vertically conveying mechanisms which carry developing material to the upper part of the belt assembly whereat the material is dispensed and directed to cascade down over the upwardly moving inclined selenium belt 12 in order to provide development of the electrostatic image.

As the developing material is cascaded over the xerographic plate, toner particles in the development material are deposited on the belt surface to form powder images. As toner powder images are formed additional toner particles are supplied to the developing material in proportion to the amount of toner deposited on the belt during xerographic processing. For this purpose, a toner dispenser generally indicated by reference numeral 15 is used to accurately meter toner to the developer material in the developer assembly 14.

The developed electrostatic image is transported by the belt 12 to a transfer station C whereat a sheet of copy paper is moved at a speed in synchronism with the moving belt in order to accomplish transfer of the developer image. There is provided at this station a suitable sheet transport mechanism adapted to transport sheets of paper from a paper handling mechanism generally indicated by the reference numeral 18 to the developed image on the belt at the station B.

After the sheet is stripped from the belt 12, it is conveyed into a fuser assembly generally indicated by the reference numeral 21 wherein the developed and transferred xerographic powder image on the sheet material is permanently affixed thereto. After fusing, the finished copy is discharged from the apparatus at a suitable point for collection externally of the apparatus.

It is believed that the foregoing description is sufficient for the purposes of this application to show the general operation of an electrostatic copier using an illumination system constructed in accordance with the invention. For further details concerning the specific construction of the electrostatic copier, reference is made to U.S. Pat. No. 3,661,452, issued in the name of Hewes et al.

Figure 2:
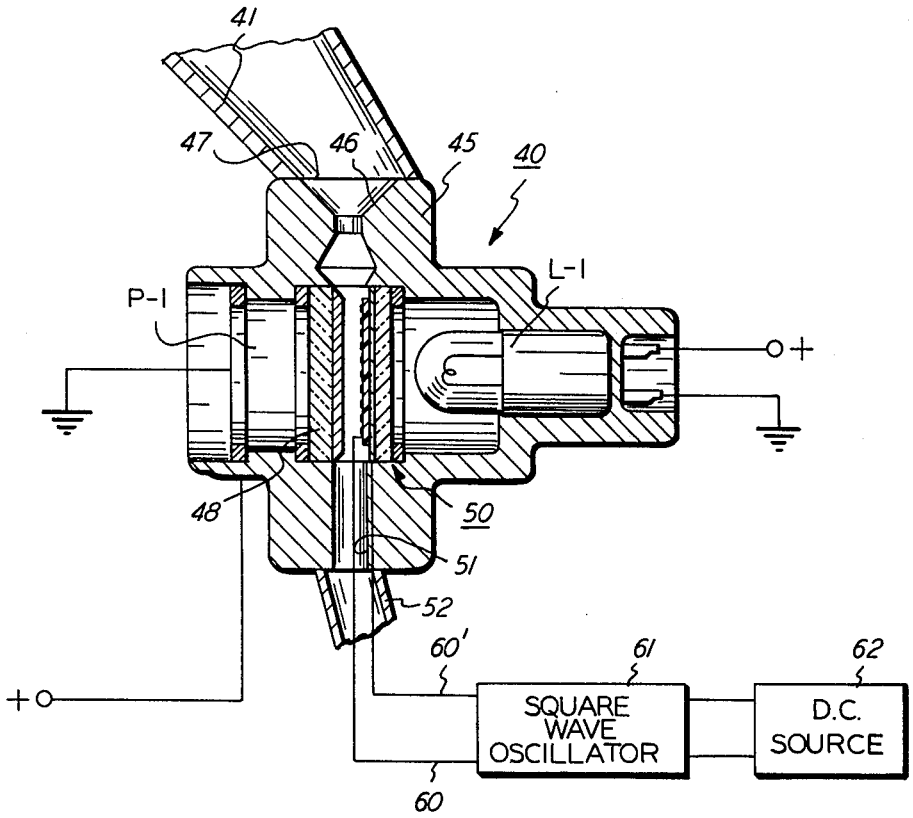
FIG. 2 is a sectional view of a toner sensor utilized in the machine shown in FIG. 1.

Referring now to FIGS. 1 and 2, the toner dispenser 15 consists of a hopper or container 30 for the toner particles to be dispensed. Although the hopper or container 30 may be made in any size or shape, the hopper shown is formed as a rectangular open-ended box having tapering side and end walls.

The bottom wall of the hopper 30 may comprise a sliding perforated plate 31 adapted for sliding movement horizontally of the hopper for metering the flow of toner from the hopper. The toner thus dispensed is mixed with the developing material in the developer housing for the apparatus 14 to become almost immediately effective in the developing process. The metering provided by the plate 31 may be controlled by a mechanical device, generally indicated by the reference numeral 32 such as a cam plate or linkage system which converts rotary motion of an electrical motor to reciprocable movement. Preferably, a single revolution of a rotary element in the device 32, say, in the form of a motor shaft, will produce one reciprocable cycle of the plate 31, thereby insuring the dispensing of predictable quantities of toner. Further details of the plate 31, the linkage system and mechanical device 32 are not necessary to understand the present invention. A preferred form of these devices is illustrated and described in U.S. Pat. No. 3,527,387, issued in the name of C. D. Wilson.

In the operation of the toner dispenser, a supply of toner particles is placed within the hopper, the hopper walls and the dispensing plate 31 forming a reservoir for the toner particles. Upon reciprocation of the plate 31 by the device 32, a metered quantity of toner particles will be permitted to enter the apparatus 14. Since the toner dispenser 15 dispenses a uniform quantity of toner for a given stroke length of the metering plate 31, it is apparent that the quantity of toner delivered by the toner dispenser may be varied by varying the number of strokes per actuation of the device 32.

In order to control the dispensing of toner from the toner dispenser 15, there is as shown in FIG. 2 an automatic control system which ultimately produces rotation of the rotary element in the device 32 in single revolution step-by-step operation in accordance with the demands of the control system as it determines the relationship of the toner concentration of the developing material with optimum toner conditions. Basically, the toner dispensing control system comprises a sensor generally indicated by the reference number 40 mounted within the developer assembly housing 14 by suitable means which electrically insulates the sensor from surrounding structures. Elongated baffle plates 41 are arranged below a horizontal conveyor 42 for the conveyor system for the developer system and are adapted to direct some of the developer material cascading from the conveyor 42 into the developer zone B. The plates 41 are positioned at angles relative to the vertical and arranged in such a way as to guide developer material falling therebetween into the sensor 40.

The sensor 40 comprises a housing 45 attached to the lower edges of the plates 41, and is formed with a funnel-shaped inlet opening 46 for presenting a circular flow orifice 47 through which entering development material may pass. The diameter of this orifice is such that the rate of flow of developing material through it remains constant. Within the housing 45 there is positioned a first sensor plate 48 arranged in a vertical plane and having a generally rectangular configuration. For practical purposes the plate may be of a size having approximately ½ inch for each side. A second sensor plate 50 is also arranged in the housing 45 parallel with the plate 48 and spaced therefrom a short distance.

The spacing between the plates 48, 50 may be on the order of one-tenth of an inch and is arranged below the flow orifice 47 in the inlet portion 46 of the housing 45. Developing material flows by action of gravity through the flow orifice 47 and between the plates 48 and 50, through the sensor 40 and out of the sensor by way of the outlet portion 51. The material is then conveyed by a duct 52 connected between the outlet 51 and the lower conveyor 53 for the developing apparatus 14 in order to return the material back into the developing system for the machine.

Figure 4:
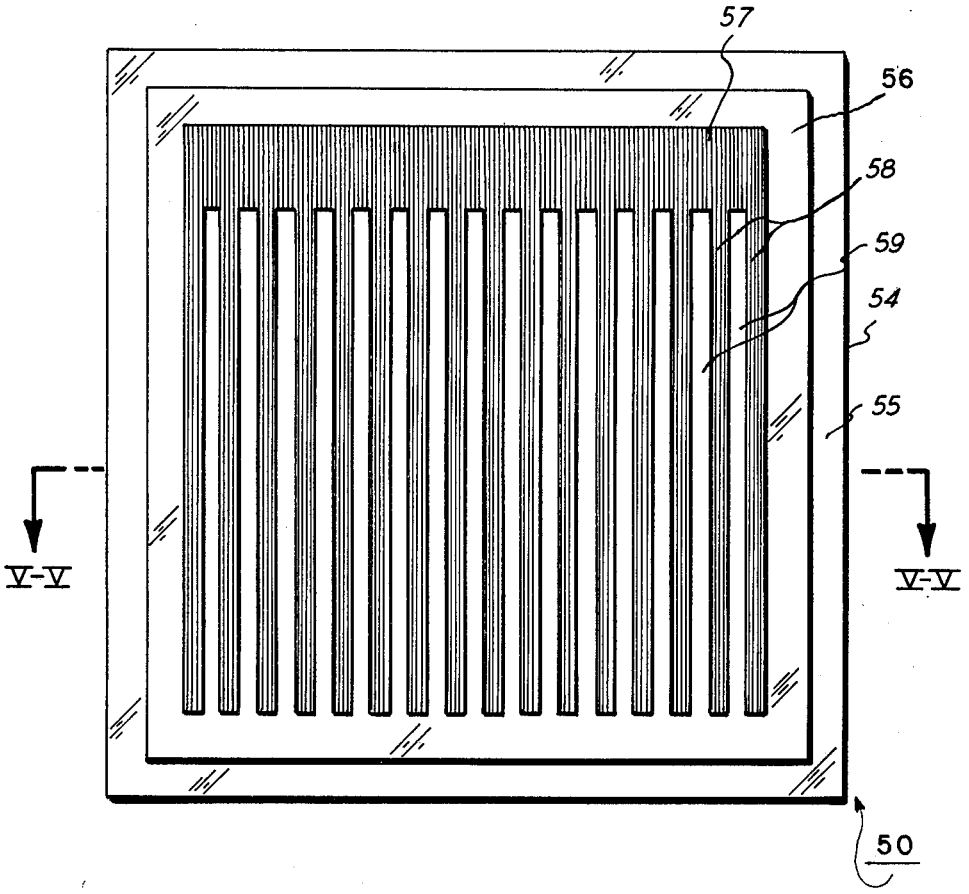
FIG. 4 is a top plan view of a fringe field electrode forming a part of the sensor of FIG. 2.
Figure 5:
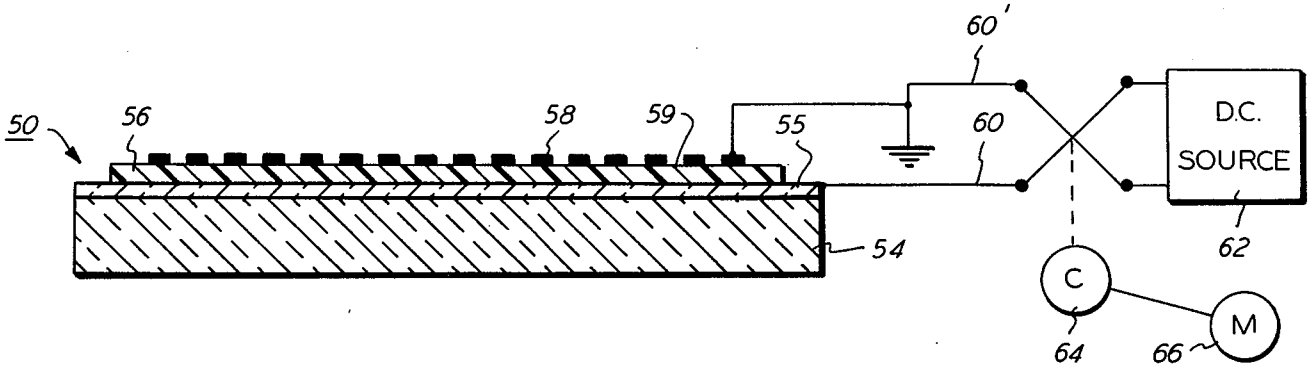
FIG. 5 is a cross-sectional view taken on the line V—V of FIG. 4.

The plate or electrode structure 50 as shown in FIGS. 4 and 5 comprises a transparent conducting substrate or electrode 54 having a conducting layer 55 on top of which is provided a transparent insulating layer 56. On top of the insulating layer is provided a set of electrically conducting fingers or electrodes 58 which are masked or are themselves of sufficient thickness to render them opaque. Masking can be arranged by any well known technique. The fingers are arranged such that a transparent area is delineated between each pair of fingers. Accordingly, as shown in FIG. 4, there is a series of alternating transparent areas or windows 59 and opaque areas 58. The fingers are interconnected to each other as indicated at 57. Preferably, as shown in FIGS. 2 and 5, conductors 60-60' connect the fingers 58 and the conducting layer 55 of the substrate 54 to a square wave oscillator 61. Alternatively, as shown in FIG. 5, the oscillator could be replaced by a reversing switch comprising a pair of micro-switches actuatable by a rotatable cam 64 mounted on the shaft of a slow speed motor 66.

During operation of the sensor 40, the fingers 58 are grounded and the substrate 54 is alternately driven positive and negative. When a positive polarity is applied to the substrate a fringe field is created in the window areas intermediate the fingers. This fringe field causes negative toner particles to be attracted to the window areas. When a negative polarity is applied to the substrate, toner is scavenged from the window area and is deposited on the opaque fingers. Thus, the transmission optical density of the electrode structure in the window areas 59 swings between a well-defined maximum and minimum. In the case of positively charged toner, a negative polarity applied to the substrate 54 will result in a fringe field being created in the window areas.

The sensor 40 also includes a photocell P-1 positioned in close proximity to the side of the sensor plate 48 away from the space between the sensor plates. A lamp L-1 is also mounted in the sensor 40 and is arranged in close proximity to the side of the sensor plate 50 away from the spacing between sensor plates and in alignment with the plates and the photocell P-1. The relative positioning of the photocell and the lamp is such that the photocell will receive the light rays which have passed through the developer material which is cascading between the plates, and the accumulated toner on the detector plate. The lamp is connected to a suitable source of electrical power to a control circuit for effecting the energization of the lamp during sensing operation, say for example, when the machine is turned "On".

Sensing control is accomplished by the present invention by continuously measuring the amount of toner that accumulates on the window areas 59 during multiple cycles of attract and clean actions. A single sensing cycle includes the time when toner is attracted to the window areas while it is being repelled from the opaque fingers, together with the period when the opaque fingers attract toner and toner is repelled from the windows.

Figure 3:
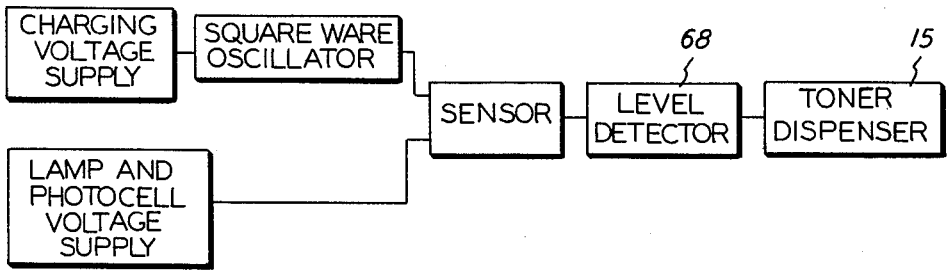
FIG. 3 is a block diagram of the functional arrangement of a toner dispensing control system in which the present invention may be utilized.

The functional diagram in FIG. 3 illustrates the general operation to which the sensor 40 may be applied. Assuming the sensor 40 is provided with lamp and photocell voltages and that the operating voltage is applied to the electrode 54, the system is in condition for control operation. As the oscillator circuit 61 is energized, say for example, as the reproduction machine is placed in its operating mode, electrode 58 is grounded and an oscillating voltage is applied to transparent electrode 54, and the sensor 40 will then be in condition to control toner addition in the developing system for the machine. As toner in the developing system depletes during machine operation, the output level of the photocell P-1 in the sensor is detected by a level detector circuit 68, which may be present with a predetermined threshold level, indicative of optimum toner content. A toner depletion will result in an increase of the output level from the sensor in accordance with the depletion of toner and when this level attains an unacceptable value, the resultant deviation in level value is sensed by the detector 68. The detector 68 compares the sensor output level with the threshold level and produces a control signal to activate the toner dispenser 15 for adding more toner to the developing system. The dispenser adds toner in small amounts until the signal from the level detector 68 terminates.

What is claimed is:

1. An automatic development control apparatus for use in electrophotographic machines wherein a pair of said parallel members form a channel through which developer material passes, one of members being constructed such that toner can be electrostatically attracted thereto and scavenged therefrom for permitting the concentration of the toner in the developer to be measured from the optical density of the toner attracted to the said one of the members, the improvement comprising said one of said members comprising:

a uniform, transparent conductive substrate;

a transparent insulating layer covering said substrate;

a plurality of spaced-apart, opaque fingers on said insulating layer, said fingers being interconnected and electrically conductive;

means for grounding said fingers and means for alternately applying positive and negative voltages to said substrate.

2. An automatic development control apparatus comprising: a pair of planar electrode members, one of said pair of planar electrode members comprising spaced apart electrodes;

electrically insulating means separating said electrode members, said insulating means being transparent and at least some of said electrodes being opaque and being arranged such that there are alternate areas of transparent insulating material and opaque electrodes;

means for grounding one of said electrode members;

means for driving the other of said electrode members alternately positive and negative whereby toner is alternately attracted to said alternate areas of transparent insulating material and opaque electrodes; and means for sensing the optical density of the toner attracted to said alternate areas of transparent insulating material and generating signals for controlling a toner dispenser.

* * * * *